US010094147B2

(12) United States Patent
Lujan et al.

(10) Patent No.: US 10,094,147 B2
(45) Date of Patent: Oct. 9, 2018

(54) REAR COMPARTMENT LATCH WITH POWER AND MANUAL RELEASE MECHANISM

(71) Applicants: Francisco Javier Lujan, Cuidad Juárez (MX); Ian J. Dow, Bloomfield, MI (US); Fernando Burciaga, Cuidad Juárez (MX); Rodrigo Alonso Galindo, Cuidad Juárez (MX); Donald M. Perkins, Sterling Heights, MI (US); John R. Rice, New Baltimore, MI (US)

(72) Inventors: Francisco Javier Lujan, Cuidad Juárez (MX); Ian J. Dow, Bloomfield, MI (US); Fernando Burciaga, Cuidad Juárez (MX); Rodrigo Alonso Galindo, Cuidad Juárez (MX); Donald M. Perkins, Sterling Heights, MI (US); John R. Rice, New Baltimore, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 221 days.

(21) Appl. No.: 13/858,538

(22) Filed: Apr. 8, 2013

(65) Prior Publication Data

US 2013/0270840 A1 Oct. 17, 2013

Related U.S. Application Data

(60) Provisional application No. 61/623,971, filed on Apr. 13, 2012.

(51) Int. Cl.
*E05C 3/06* (2006.01)
*E05B 83/18* (2014.01)
(Continued)

(52) U.S. Cl.
CPC ..... *E05B 83/18* (2013.01); *E05B 81/14* (2013.01); *E05C 19/12* (2013.01); *E05B 81/06* (2013.01);
(Continued)

(58) Field of Classification Search
CPC ..... E05B 83/16; E05B 83/18; E05B 83/26; E05B 81/14; E05B 81/16; E05B 81/18;
(Continued)

(56) References Cited

U.S. PATENT DOCUMENTS 3,857,001 A * 12/1974 Quantz ..... 200/61.64
4,298,223 A * 11/1981 Raffelsiefer et al. ..... 292/216
(Continued)

FOREIGN PATENT DOCUMENTS

CA 2324720 A1 * 4/2002
CN 1782310 A 6/2006
(Continued)

OTHER PUBLICATIONS

Computer Generated Translation for FR 2906291, Generated on Dec. 20, 2017, https://worldwide.espacenet.com/ (Year: 2017).*
(Continued)

*Primary Examiner* — Alyson M Merlino
(74) *Attorney, Agent, or Firm* — Cantor Colburn LLP

(57) ABSTRACT

A latch is provided including a claw configured to rotate between an open position and a closed position. A pawl is rotatable in and out of engagement with the claw. The latch includes a first release mechanism, a second release mechanism, and a third release mechanism. The first release mechanism applies a rotational force to a first portion of the pawl to rotate the pawl out of engagement with the claw. The second release mechanism applies a rotational force to a second portion of the pawl to rotate the pawl out of engagement with the claw. The third release mechanism applies a
(Continued)

rotational force to a first portion of the pawl to rotate the pawl out of engagement with the claw.

17 Claims, 5 Drawing Sheets

(51) Int. Cl.

| | |
|---|---|
| ***E05C 19/12*** | (2006.01) |
| ***E05B 81/14*** | (2014.01) |
| *E05C 3/16* | (2006.01) |
| *E05B 81/06* | (2014.01) |
| *E05B 81/34* | (2014.01) |

(52) U.S. Cl.
CPC ..... *E05B 81/34* (2013.01); *Y10T 292/0945* (2015.04); *Y10T 292/0949* (2015.04); *Y10T 292/0951* (2015.04)

(58) Field of Classification Search
CPC ..... E05B 81/64; E05B 81/66; E05B 81/90; E05B 77/36; E05B 77/38; E05B 77/40; E05B 77/42; E05B 81/06; E05B 81/34; E05C 19/12
USPC ..... 292/201, 216, DIG. 23, DIG. 42
See application file for complete search history.

(56) References Cited

U.S. PATENT DOCUMENTS

| | | | | |
|---|---|---|---|---|
| 4,783,103 | A * | 11/1988 | Schlegel | 292/216 |
| 5,020,838 | A * | 6/1991 | Fukumoto | 292/201 |
| 5,277,461 | A * | 1/1994 | Dzurko et al. | 292/216 |
| 5,288,115 | A * | 2/1994 | Inoue et al. | 292/201 |
| 5,308,128 | A * | 5/1994 | Portelli et al. | 292/216 |
| 5,348,357 | A * | 9/1994 | Konchan et al. | 292/216 |
| 5,632,515 | A * | 5/1997 | Dowling | 292/216 |
| 5,642,636 | A * | 7/1997 | Mitsui | 70/237 |
| 6,264,253 | B1 * | 7/2001 | Takaishi | 292/216 |
| 8,182,004 | B2 | 5/2012 | Yoda | |
| 8,657,348 | B2 | 2/2014 | Coleman et al. | |
| 8,757,682 | B2 | 6/2014 | Scholz et al. | |
| 2003/0001397 | A1 * | 1/2003 | Mork et al. | 292/216 |
| 2003/0081995 | A1 * | 5/2003 | Acciacca | 403/353 |
| 2003/0227177 | A1 * | 12/2003 | Matsuda et al. | 292/216 |
| 2004/0245786 | A1 * | 12/2004 | Hashiba et al. | 292/216 |
| 2005/0040656 | A1 * | 2/2005 | Taga | 292/201 |
| 2005/0077734 | A1 * | 4/2005 | Lim | 292/216 |
| 2005/0156436 | A1 * | 7/2005 | Ju et al. | 292/216 |
| 2006/0103145 | A1 | 5/2006 | Ottolini et al. | |
| 2007/0126244 | A1 * | 6/2007 | Ilea et al. | 292/201 |
| 2009/0160198 | A1 | 6/2009 | Yoda | |
| 2011/0187132 | A1 | 8/2011 | Scholz et al. | |
| 2011/0278867 | A1 * | 11/2011 | Watanabe et al. | 292/341.16 |
| 2012/0091738 | A1 | 4/2012 | Coleman et al. | |
| 2012/0313384 | A1 | 12/2012 | Cumbo et al. | |
| 2014/0062100 | A1 * | 3/2014 | Tamura | 292/100 |
| 2014/0203573 | A1 * | 7/2014 | Lujan et al. | 292/217 |
| 2014/0312629 | A1 | 10/2014 | Coleman et al. | |

FOREIGN PATENT DOCUMENTS

| | | | |
|---|---|---|---|
| CN | 101463684 | A | 6/2009 |
| CN | 102165130 | A | 8/2011 |
| DE | 19622654 | A1 * | 12/1996 |
| DE | 102011103365 | A1 | 1/2012 |
| FR | 2906291 | A1 * | 3/2008 |
| WO | 2011094834 | A1 | 8/2011 |

OTHER PUBLICATIONS

English Translation of Third Chinese Office Action for Patent Application No. 201310126360.1; dated May 9, 2016; 9 pgs.
Third Chinese Office Action for Patent Application No. 201310126360.1; dated May 9, 2016; 4 pgs.
English Translation of WO2011094834 Abstract.
English Translation of DE102011103365 Abstract.
English Translation of CN102165130 Abstract.
English Translation of CN101463684 Abstract.
First Office Action for Chinese Application. No. 2013101263601 dated Feb. 16, 2015.
English Translation of First Office Action for Chinese Application. No. 2013101263601 dated Feb. 16, 2015.
English Translation of Second Office Action for Chinese Application. No. 2013101263601 dated Nov. 3, 2015.
Second Office Action for Chinese Application. No. 2013101263601 dated Nov. 3, 2015.

* cited by examiner

REAR COMPARTMENT LATCH WITH POWER AND MANUAL RELEASE MECHANISM

CROSS REFERENCE TO RELATED APPLICATIONS

This application claims the benefit of U.S. Provisional Patent Application No. 61/623,971 filed Apr. 13, 2012, the entire contents of which are incorporated herein by reference thereto.

TECHNICAL FIELD

Exemplary embodiments of the present invention relate generally to a latch mechanism and, more particularly, to a latch having a release mechanism.

BACKGROUND

Latch designs need to accommodate different packaging requirements for various applications such as lift gates, rear compartments, and decklids. Companies would like to introduce new features for their vehicles, such as sound quality and reduced size for example, even on components such as latches. Some of these features, for instance the power release, are rapidly increasing in popularity. Consequently, the space available for latch mechanisms continues to decrease due to the desire to include additional components and features within the vehicle. The need for multiple latch packages and feature sets per vehicle results in multiple latch design variations. Manufacturers, however, want to standardize the parts in order to reduce manufacturing and assembly costs.

Accordingly, while existing vehicle latch mechanisms are suitable, the need for improvement remains, particularly in providing more compact and cost-effective latch mechanisms that may be used in multiple vehicles and can accommodate different features.

SUMMARY OF THE INVENTION

According to an exemplary embodiment of the present invention, a latch is provided including a claw configured to rotate between an open position and a closed position. A pawl is rotatable in and out of engagement with the claw. The latch includes a first release mechanism, a second release mechanism, and a third release mechanism. The first release mechanism applies a rotational force to a first portion of the pawl to rotate the pawl out of engagement with the claw. The second release mechanism applies a rotational force to a second portion of the pawl to rotate the pawl out of engagement with the claw. The third release mechanism applies a rotational force to a first portion of the pawl to rotate the pawl out of engagement with the claw.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

With reference to all of the figures, an exemplary latch 10 having a power release mechanism 19 and a manual release mechanism 39 to open the latch 10 is illustrated. This latch 10 may be integrated into a component of a vehicle, such as the vehicle structure adjacent a lift gate or trunk for example.

Figure 1:
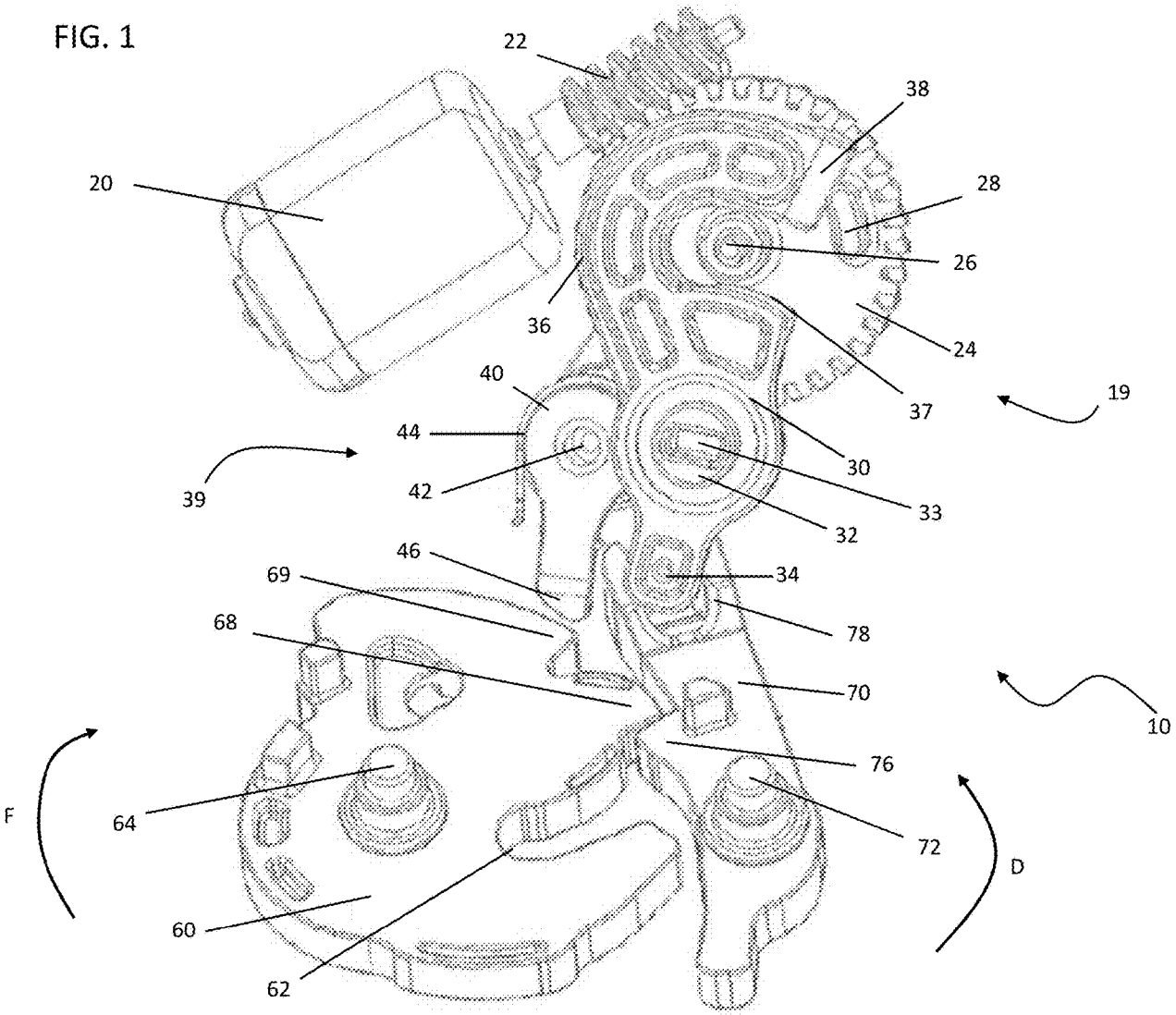
FIG. 1 is a perspective view of a closed latch according to an exemplary embodiment of the present invention.
Figure 2:
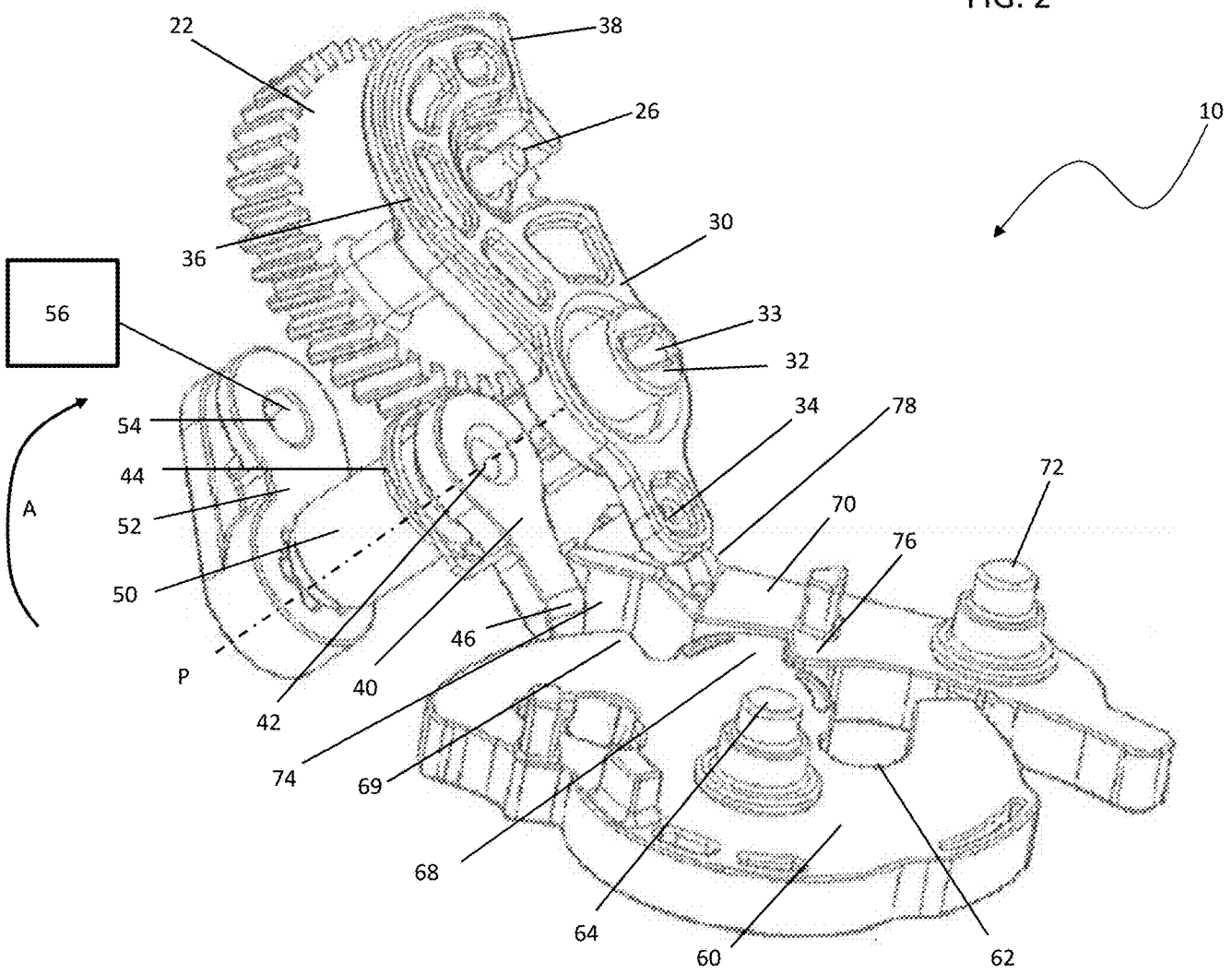
FIG. 2 is a perspective view of the closed latch according to an exemplary embodiment of the present invention.

Referring now to FIGS. 1-2, the exemplary latch 10 is illustrated in a closed or engaged position. The latch 10 includes a claw 60 and a cooperating pawl 70. In one embodiment, the claw 60 is made from metal over molded in plastic. The claw 60 and the pawl 70 are pivotally mounted by studs 64 and 72 respectively. The claw 60 is biased in the direction indicated by arrow F and the pawl 70 is biased in the direction indicated by arrow D into engagement with the claw 60. In one embodiment, each of the claw 60 and the pawl 70 are biased by a respective spring (not shown), such as a torsion spring for example. The claw 60 has slot or throat 62 for receiving and retaining a striker (not shown) located on a complementary vehicle component, such as a lift gate or trunk. The claw 60 additionally includes a primary shoulder 68 and an intermediate secondary shoulder 69. The pawl 70 has a sector shaped catch 76 that can positively engage each of the primary and secondary latch shoulders 68, 69 to hold the claw 60 against the bias of the spring in either a primary or secondary latched position respectively.

The power release mechanism 19 of the latch 10 includes a bellcrank lever 30, positioned near the pawl 70 and rotatable about a pin 32. In one embodiment, the bellcrank lever 30 includes a generally curved body 36 extending from adjacent pin 32 to a first end 38. The curved body 36 includes a slot 37 to prevent interference with an adjacent stud 26 as the bellcrank lever 30 rotates about pin 32. A second end of the bellcrank lever 30 includes a foot 34. The foot 34 is disposed adjacent a first portion 78 of the pawl 70. In one embodiment, the first portion 78 is a protrusion extending generally perpendicularly from the planar surface of the pawl 70. In one embodiment, the first portion 78 is adjacent a surface opposite the surface of the pawl 70 facing the claw 60. When the bellcrank lever 30 is rotated, the foot 34 engages the first portion 78, thereby pivoting the pawl 70 in a direction opposite the direction indicated by arrow D, out of engagement with either the primary or secondary shoulder 68, 69 of the claw 60.

Located adjacent and generally parallel to the bellcrank lever 30 is a driven gear 24, such as a rotary gear for example, mounted for rotation about stud 26. The driven gear 24 engages a pinion 22, such as a helical gear or worm gear for example, connected to a drive shaft of a motor 20. When the motor 20 is energized, the rotation of the pinion 22 is imparted to the driven gear 24. A gear protrusion 28 extends generally perpendicularly from a planar surface of the driven gear 24 in the direction of the bellcrank lever 30 for engagement with the first end 38.

The latch 10 additionally includes a manual release mechanism 39 having an arm lever 40 rotatable about a central axis P of pin 42. An arm extends from the arm lever 40, such that the first end 46 of the arm is positioned near the claw 60 and a second portion 74 of the pawl 70. In one embodiment, the second portion 74 is a protrusion extending generally perpendicularly from the planar surface of the pawl 70 and the protrusion is adjacent a surface facing the claw 60. A torsion spring 44 biases the arm lever 40 in the direction indicated by arrow A. The pin 42 fastens the arm lever 40 to a manual release lever 52 along the axis P. A portion 50 of the arm lever 40 extends along the length of axis P in the direction of the manual release lever 52, such that the first end 46 of the arm lever 40 is positioned adjacent the claw 60 and the pawl 70 and the manual release lever 52 is located in a position where it can rotate freely without interference from the power release mechanism 19 and other components of the latch 10. The manual release lever 52 is operably coupled to a handle 56 about hole 54 such that actuation of the handle 56 causes the manual release lever 52 and the fixed arm lever 40 to rotate about central axis P in a direction opposite the direction indicated by arrow A. The handle 56 may be either an external handle or an internal handle of an associated vehicle.

Figure 3:
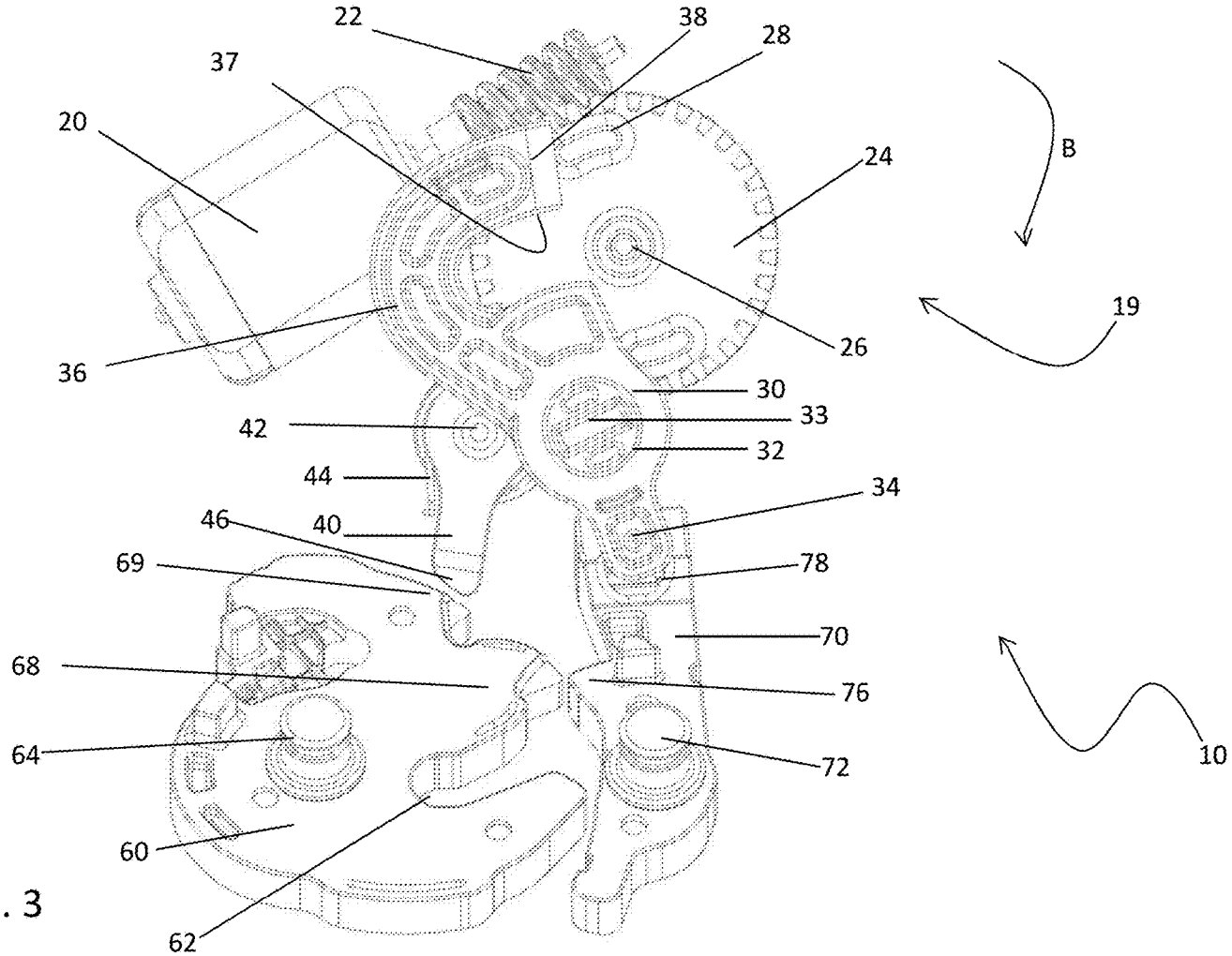
FIG. 3 is a perspective view of the open according to an exemplary embodiment of the present invention.

Referring now to FIG. 3, the illustrated latch 10 has been opened using the power release mechanism 19. To operate the power release mechanism 19 to release the striker (not shown), power is applied to the motor 20. As the driven gear 24 coupled to the motor shaft rotates, the gear protrusion 28, extending from a surface of the driven gear 24, contacts the first end 38 of the bellcrank lever 30 causing the bellcrank lever 30 to rotate about pin 32 in a direction opposite the direction indicated by arrow B. This rotation causes the foot 34 of the bellcrank lever 30 to rotate into engagement with the first portion 78 of the pawl 70. Additional rotation of the bellcrank lever 30 imparts the rotational force to the pawl 70, such that the pawl 70 pivots about stud 72, thereby disengaging the sector shaped catch 76 from the claw 60 and opening the latch 10. When power is removed from the motor 20, a spring (not shown) biases the pawl 70 in the direction indicated by arrow D. The first portion 78 of the pawl 70 engages the foot 34 of the bellcrank lever 30, such that the pawl 70 and the bellcrank lever 30 rotate to a neutral or home position.

Figure 4:
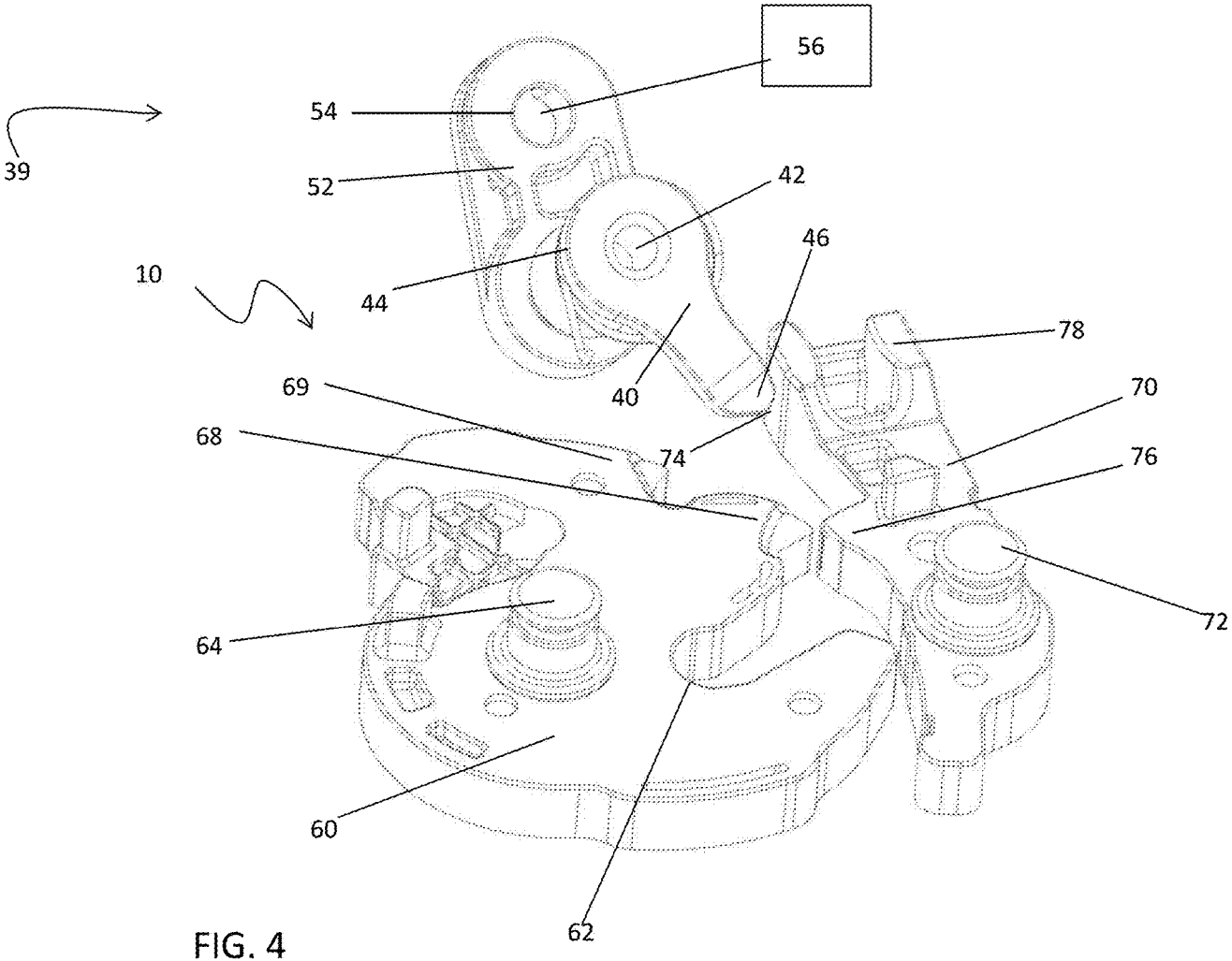
FIG. 4 is a perspective view of the open latch according to an exemplary embodiment of the present invention.

Referring now to FIG. 4, the illustrated latch 10 has been opened or disengaged using the manual release mechanism 39. In the event that the power release mechanism 19 does not open the latch, the manual release mechanism 39 may be operated to release the striker (not shown) regardless of the position of the power release mechanism 19 when it did not operate. To operate the manual release mechanism 39, the handle 56 connected to the manual release lever 52 is actuated. Because arm lever 40 is fixed to the manual release lever 52 by pin 42, rotation of the manual release lever 52 in a direction away from the power release mechanism 19, and opposite the direction indicated by arrow A (FIG. 2), causes rotation of the arm lever 40 about central axis P (see FIG. 2). This rotation causes the first end 46 of the arm lever 40 to contact a second portion 74 of the pawl 70. Further rotation of the manual release mechanism 52 causes the pawl 70 to rotate about stud 72, in a direction opposite the direction indicated by arrow D (FIG. 1), out of engagement with the claw 60. When the rotational force applied to the manual release mechanism is removed, a spring (not shown) biases the pawl 70 in the direction indicated by arrow D. The second portion of the pawl 70 contacts the first end 46 of the arm lever 40, such that both the pawl 70 and the arm lever 40 rotate back to a neutral or home position.

The latch 10 additionally includes an emergency release mechanism, illustrated in FIG. 3, for disengaging the latch 10 when the power release mechanism and the manual release mechanism are not operable by the user. The emergency release mechanism is accessible from inside the compartment that the latch 10 is connected to and may be used to escape when trapped within the compartment. The pin 32, around which the bellcrank lever 30 rotates, includes a slot 33. In one embodiment, the slot 33 is generally rectangular and is designed for receiving a tool, such as a flathead screwdriver for example. Application of a rotational force to a tool (not shown) inserted into the slot 33, will cause the bellcrank lever 30 to rotate about the pin 32 and move the pawl 70 out of engagement with the claw 60.

Figure 5:
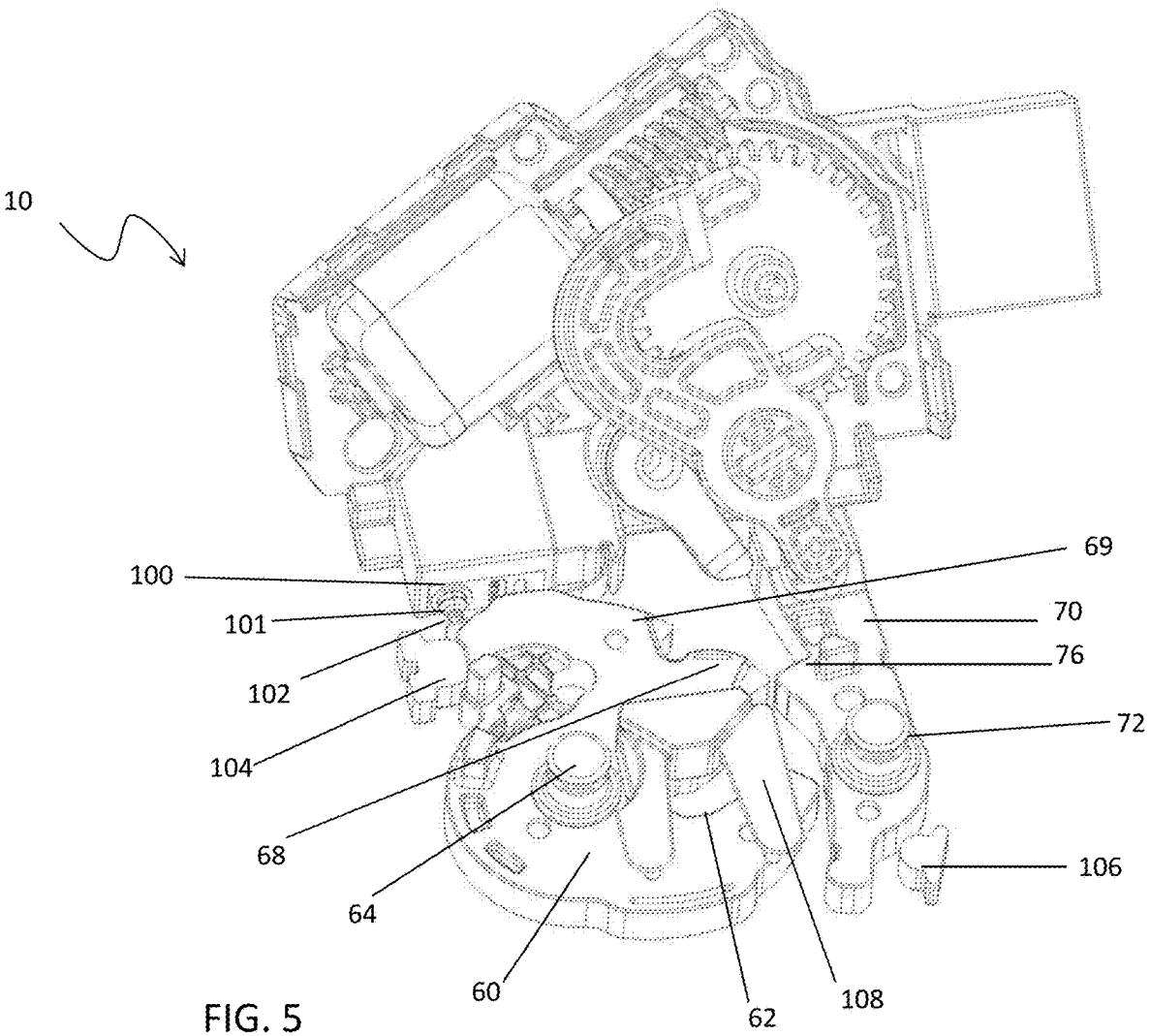
FIG. 5 is a perspective view of the latch according to an exemplary embodiment of the present invention.

The exemplary latch 10 of FIG. 5 illustrates a plurality of additional features that may be integrated individually or in combination into the latch 10. In one embodiment, a claw bumper 104 is disposed adjacent a portion of the claw 60. The claw bumper 104 limits the rotation of the claw 60 between a disengaged and an engaged position. In another embodiment, a switch 101 is coupled to a housing 100 adjacent the claw 60. A resilient member 102 extends at an angle from the housing 100 between the claw 60 and the switch 101, such that rotation of the claw 60 to an engaged position causes the resilient member 102 to rotate and engage the switch 101. In another embodiment, a detent bumper 106 is positioned adjacent a portion of the pawl 70. Similar to the claw bumper 104, the detent bumper 106 limits the rotational movement of the pawl 70 about stud 72. In another embodiment, a striker bumper 108 is disposed on a surface of the claw 60 to control the movement of the striker (not shown) relative to the claw 60.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch, comprising:

a claw configured to rotate between an open position and a closed position;

a pawl configured to rotate, wherein the pawl rotates into and out of engagement with the claw;

a power release mechanism that contacts a first portion of the pawl during operation of the power release mechanism in order to apply a rotational force to the first portion of the pawl to pivot the pawl out of engagement with the claw, wherein the power release mechanism includes a bellcrank lever rotatably mounted about an axis, wherein the bellcrank lever includes a curved portion extending from a portion of the bellcrank lever rotatably mounted about the axis and a foot extending from the portion of the bellcrank lever rotatably mounted about the axis, wherein the foot is positioned adjacent to the first portion of the pawl; a motor, wherein a first gear is coupled to a shaft of the motor; and a second gear coupled for rotation with the first gear, the second gear being rotatably mounted about a stud and having a gear protrusion for engagement with a first end of the bellcrank lever, wherein the curved portion of the bellcrank lever is positioned about the stud;

a manual release mechanism that contacts a second portion of the pawl during operation of the manual release mechanism in order to apply a rotational force to the second portion of the pawl to pivot the pawl out of engagement with the claw, wherein the manual release mechanism comprises a manual release lever located in a position in which it can freely rotate without interference from the power release mechanism; and an emergency release mechanism, wherein operation of the emergency release mechanism applies a rotational force to the first portion of the pawl to pivot the pawl out of engagement with the claw.

2. The latch according to claim 1, wherein the second portion of the pawl is located opposite the claw and the first portion of the pawl is located adjacent an opposite surface of the pawl.

3. The latch according to claim 1, wherein the first portion of the pawl is a protrusion extending generally perpendicular from a planar surface of the pawl.

4. The latch according to claim 1, wherein operation of the motor causes the foot to rotate into engagement with the first portion of the pawl.

5. The latch according to claim 1, wherein a spring biases the pawl and the bellcrank lever into a home position.

6. The latch according to claim 1, wherein the second gear is a rotary gear.

7. The latch according to claim 1, wherein the manual release lever is configured to rotate about an axis, wherein the manual release lever is operably coupled to a handle; and an arm lever is fastened to the manual release lever, the arm lever having a first end positioned adjacent the second portion of the pawl.

8. The latch according to claim 7, wherein actuation of the handle causes the first end of the arm lever to rotate into engagement with the second portion of the pawl.

9. The latch according to claim 7, wherein a spring biases the pawl and the arm lever into a home position.

10. The latch according to claim 7, wherein the handle is an external handle.

11. The latch according to claim 7, wherein the handle is an internal handle.

12. The latch according to claim 1, wherein the emergency release mechanism further comprises:

a slot, wherein a rotational force applied to the slot causes a rotational force to be applied to the first portion of the pawl.

13. The latch according to claim 1, wherein the claw is metal over molded in plastic.

14. The latch according to claim 1, wherein a claw bumper is disposed adjacent the claw.

15. The latch according to claim 1, wherein a detent bumper is disposed adjacent the pawl.

16. The latch according to claim 1, wherein a resilient member extends from a housing adjacent the claw such that rotation of the claw causes the resilient member to engage a switch.

17. The latch according to claim 1, wherein a striker bumper is disposed adjacent the claw.

* * * * *